US007046951B2

(12) United States Patent
Kim et al.

(10) Patent No.: US 7,046,951 B2
(45) Date of Patent: May 16, 2006

(54) FUSING ROLLER USED WITH AN IMAGE FORMING APPARATUS AND A METHOD OF MANUFACTURE THEREOF

(75) Inventors: Hwan-guem Kim, Seoul (KR); Durk-hyun Cho, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 52 days.

(21) Appl. No.: 10/782,915

(22) Filed: Feb. 23, 2004

(65) Prior Publication Data

US 2004/0253028 A1 Dec. 16, 2004

(30) Foreign Application Priority Data

Jun. 14, 2003 (KR) ..... 10-2003-0038507

(51) Int. Cl.
*G03G 15/20* (2006.01)

(52) U.S. Cl. ..... 399/330; 219/216; 399/90

(58) Field of Classification Search ..... 399/88, 399/89, 320, 328, 330, 333, 335; 219/216
See application file for complete search history.

(56) References Cited

U.S. PATENT DOCUMENTS 6,628,917 B1 * 9/2003 Lee ..... 399/330

FOREIGN PATENT DOCUMENTS

JP 2002-110325 4/2002

OTHER PUBLICATIONS

Official Action issued on Feb. 25, 2005 by the Korean Intellectual Property Office and listing 1 reference.

* cited by examiner

*Primary Examiner*—Hoang Ngo
(74) *Attorney, Agent, or Firm*—Stanzione & Kim, LLP

(57) ABSTRACT

A fusing roller used with an image forming apparatus, including a heating pipe, an expandable pipe mounted within the heating pipe, a heating coil interposed between the heating pipe and the expandable pipe and generating a resistance heat when power is supplied, a terminal block connected to the heating coil to supply an external power to the heating coil, a gear cap provided at one end of the heating pipe, an outer insulator interposed between the heating pipe and the heating coil, and an inner insulator interposed between the expandable pipe and the heating coil. Since the heating coil is wound and then welded at one side of the terminal block, it is not readily detached from the terminal block.

24 Claims, 3 Drawing Sheets

FUSING ROLLER USED WITH AN IMAGE FORMING APPARATUS AND A METHOD OF MANUFACTURE THEREOF

CROSS-REFERENCE TO RELATED APPLICATIONS

This application claims the benefit of Korean Patent Application No. 2003-38507 filed with the Korea Intellectual Property Office on Jun. 14, 2003, the disclosure of which is incorporated herein by reference.

BACKGROUND OF THE INVENTION

1. Field of the Invention

The present invention relates to a fusing roller used with an image forming apparatus and a method of manufacturing the same.

2. Description of the Related Art

As generally known in the art, an electrophotographic image forming apparatus comprises a laser scanning unit, a photosensitive member, a developing device and a fusing roller. The laser scanning unit generates laser light and emits it to the photosensitive member so that an electrostatic latent image can be formed on the surface of the photosensitive member. The developing device affixes a toner to the electrostatic latent image formed on the surface of the photosensitive member in order to develop the electrostatic latent image, thereby producing a visible developed toner image. The toner image is transferred onto a printing paper passing between the photosensitive member and the fusing roller. The toner image is fused and stuck on the printing paper by heat and pressure when the printing paper passes between the fusing roller and a backup roller which rotates in contact with the fusing roller.

The fusing roller generates a high-temperature heat when supplied with power generally from an external source, and includes a resistor to generate a resistance heat between outer and inner metal pipes having different diameters.

FIG. 1 is a schematic view of a conventional fusing roller for an image forming apparatus. Referring to FIG. 1, an expandable pipe 11 of a conventional fusing roller 10 has an insulating layer on the outer surface thereof. Also, a heating coil 12 to generate heat is wound around the expandable pipe 11. The heating coil 12 is connected to a terminal block 13 to receive an external power. The expandable pipe 11 with the heating coil 12 wound thereon is inserted into a heating pipe (not shown) with an insulating layer on the inner circumference thereof. The external diameter of the expandable pipe 11 is then expanded so that the expandable pipe 11 can come into close contact with the heating pipe.

In the conventional fusing roller 10, the heating coil 12 is connected to the terminal block 13 by a single winding at one end of the terminal block 13. Since the heating coil 12 repeats expansion and contraction by the repeated power supply and suspension, the connection between the heating coil 12 and the terminal block 13 may be weakened. When the expandable pipe 11 is inserted into the heating pipe, its external diameter is expanded. If the outer circumference of the expandable pipe 11 does not closely contact the inner circumference of the heating pipe, the connection between the heating coil 12 and the terminal block 13 will become unstable. The weakened or unstable connection between the heating coil 12 and the terminal block 13 may generate a contact resistance between the heating coil 12 and the terminal block 13. This may cause local overheating and sparks, thereby resulting in disconnection between the heating coil 12 and the terminal block 13. Consequently, the fusing roller 11 can be overheated.

SUMMARY OF THE INVENTION

Accordingly, it is an aspect of the present invention to solve the above-mentioned and/or other problems occurring in the prior art by providing a fusing roller used with an electrophotographic image forming apparatus, which can maintain a stable connection between a terminal block and a heating coil, and a method of manufacturing the above described fusing roller.

The foregoing and/or other aspects of the present invention are achieved by providing a fusing roller used with an image forming apparatus which includes a roller body, a heating coil mounted within the roller body to generate a resistance heat when power is supplied, and a terminal block connected to the heating coil to supply an external power to the heating coil. The heating coil is wound and welded at one side of the terminal block. Furthermore, in another aspect of the present invention, the heating coil is connected to the terminal block by a two-sided spot welding using a laser.

One side of the terminal block is partially slit to form a particular size of a slit section. Preferably, the heating coil is wound and welded around the slit section.

The foregoing and/or other aspects of the present invention may also be achieved by providing a fusing roller used with an image forming apparatus including a heating pipe, an expandable pipe mounted within the heating pipe, a heating coil interposed between the heating pipe and the expandable pipe to generate a resistance heat when power is supplied, a terminal block connected to the heating coil to supply an external power to the heating coil, an outer insulator interposed between the heating pipe and the heating coil, and an inner insulator interposed between the expandable pipe and the heating coil. The heating coil is wound and welded at one side of the terminal block.

The foregoing and/or other aspects of the present invention may also be achieved by providing a fusing roller used with an image forming apparatus including a heating pipe with a Teflon coating applied on the outer surface thereof, an expandable pipe mounted within the heating pipe, a heating coil interposed between the heating pipe and the expandable pipe to generate a resistance heat when power is supplied, first and second terminal blocks connected to two respective ends of the heating coil to supply an external power to the heating coil, a gear cap and an end cap provided at two respective ends of the heating pipe, an outer insulator interposed between the heating pipe and the heating coil, an inner insulator interposed between the expandable pipe and the heating coil, and first and second electrodes provided respectively at the gear cap and the end cap to be electrically connected to the first and second terminal blocks. Each end of the heating coil is wound and welded at one side of each of the first and second terminal blocks.

The foregoing and/or other aspects of the present invention may also be achieved by providing a fusing roller comprising: a fusing roller body; a heating coil mounted within the fusing roller body to generate a resistance heat when applying a power thereto; and a connecting member to apply power to the heating coil, the connecting member being connected to the heating coil by spot welding.

The foregoing and/or other aspects of the present invention may also be achieved by providing a fusing roller comprising: a fusing roller body; a heating coil mounted within the fusing roller body to generate a resistance heat when applying a power thereto; and a connecting member to apply power to the heating coil, the connecting member having a partial slit therein in which a portion of the heating coil is wound to secure the heating coil to the connecting member.

In an aspect of the invention, the portion of the heating coil wound within the slit of the connecting member is welded at one side of the connecting member. Alternatively, the portion of the heating coil wound within the slit of the connecting member is welded at two sides of the connecting member.

The forgoing and/or other aspects of the present invention may also be achieved by providing a fusing roller comprising: a fusing roller body; a heating coil mounted within the fusing roller body to generate a resistance heat when a power is applied to the heating coil; and a connecting member having and end section and a slit section, which is flexible with respect to the end section, the slit section being connected to the heating coil.

In an aspect of the invention, the connecting member comprises a partial slit formed between the end section and the slit section. Further, the end section and the slit section are spaced apart from each other by a width of the slit. Here, one end of the heating coil is inserted into the partial slit to be connected to the slit section of the connection member. The heating coil can then be welded on the slit section.

In another aspect of the invention, the connecting member comprises a main section coupled between the slit section and an external power connector.

BRIEF DESCRIPTION OF THE DRAWINGS

These and other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
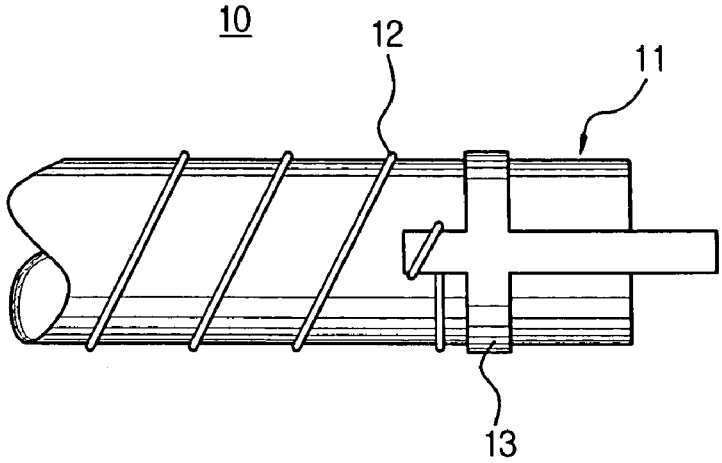
FIG. 1 (PRIOR ART)
FIG. 1 is a perspective view of a conventional fusing roller used with an image forming apparatus.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
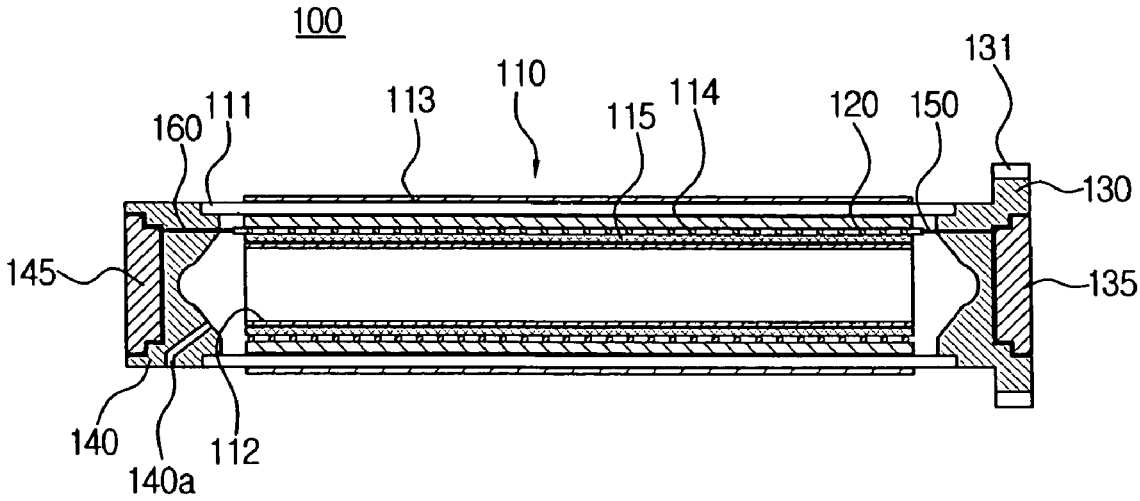
FIG. 2 is a cross-sectional view of a fusing roller for an image forming apparatus according to an embodiment of the present invention.

As shown in FIG. 2, a fusing roller 100 used with an image forming apparatus according to the present invention includes a roller body 110, a heating coil 120, a gear cap 130 and an end cap 140.

The roller body 110 includes a heating pipe 111 and an expandable pipe 112. The heating pipe 111 rotates with a printing paper while being pressurized under a predetermined pressure to heat the printing paper. The roller body 110 is made of aluminum having superior thermal conductivity. Both ends of the heating pipe 111 are opened. In order to prevent a toner image from being stuck onto the heating pipe, a coating layer 113 of a synthetic resin is formed at a predetermined thickness on the outer circumference of the heating pipe 111. An example of a type of material used as the coating layer 113 is Teflon with an improved heat resistance. For the insulation between the heating pipe 111 and the heating coil 120, an outer insulating layer 114 is formed on the inner circumference of the heating pipe 111. Preferably, a mica thin sheet can be used for the outer insulating layer 114.

The expandable pipe 112 has a diameter smaller than the heating pipe 111. When the expandable pipe 112 is inserted into the heating pipe 111, there is a predetermined space between the outer circumference of the expandable pipe 112 and the inner circumference of the heating pipe 111. The expandable pipe 112 is made of a thin aluminum tube which is less than 0.3 mm in thickness, and is made by extruding or drawing the pipe material during manufacturing thereof. With the heating coil 120 being interposed between the heating pipe 111 and the expandable pipe 112, the expandable pipe 112 is pressurized under a high pressure to expand until it comes into close contact with the heating pipe 111. In order to ensure insulation between the expandable pipe 112 and the heating coil 120, an inner insulating layer 115 is formed on the outer circumference of the expandable pipe 112. It is an aspect of the invention to use the mica thin sheet as the inner insulating layer 115, as well as the outer insulating layer 114.

Figure 3:
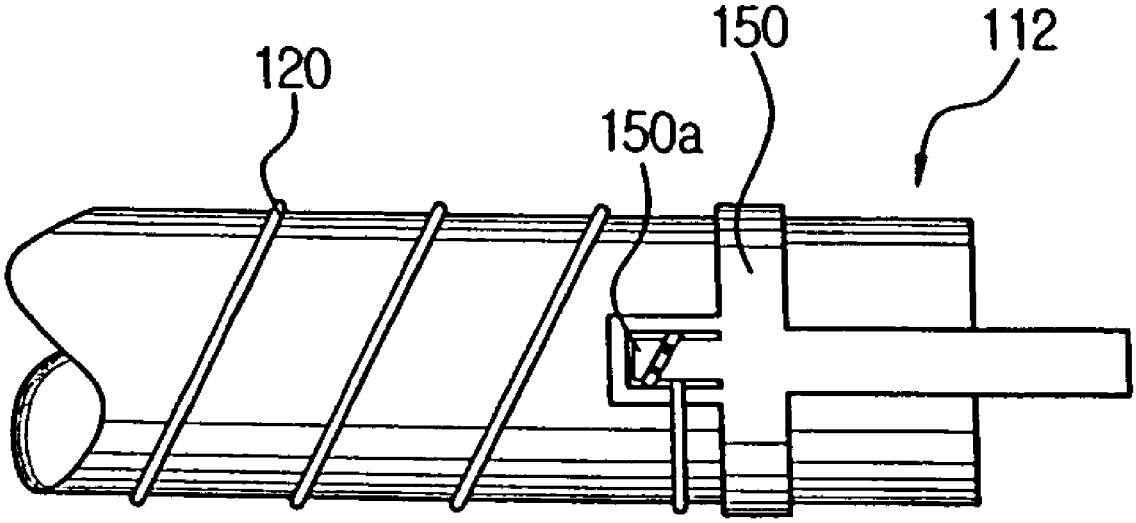
FIG. 3 is a perspective view of a core configuration of a fusing roller used with an image forming apparatus according to an embodiment of the present invention.

The heating coil 120, placed between the heating pipe 111 and the expandable pipe 112, generates a resistance heat when an external power is supplied. The heating coil 120, which is made of nickel-chrome or iron-chrome, is spirally wound between the inner insulating layer 115 and the outer insulating layer 114. The two ends of the heating coil 120 are connected respectively to first and second terminal blocks 150 and 160 to receive the external power froman external source. The first and second terminal blocks 150 and 160 are made of a metal with superior electric conductivity, such as, for example, phosphor bronze or phosphodeoxy bronze, and encircle the two ends of the expandable pipe 112 to be stably fixed to the expandable pipe 112. As illustrated in FIG. 3, the first terminal block 150 has a predetermined size of a slit section 150*a* at one side thereof. The second terminal block 160 has the same structure as explained and illustrated with respect to the first terminal block 150. Accordingly, a detailed explanation of the structure of the second terminal block 160 will be omitted. One end of the heating coil 120 is wound around the slit section 150*a* through a slit 150*b* of the first terminal block 150. The other end of the heating coil 120 is wound around the slit section 150*a* of the second terminal block 160 in the same manner. After being wound around the slit sections 150*a* of the first and second terminal blocks 150 and 160, the two ends of the heating coil 120 are welded to the respective terminal block by a two-sided spot welding using a laser. Since an external force can be absorbed at the welding point, it is possible to prevent the heating coil 120 from being easily detached from the terminal blocks 150 and 160 by the contraction and expansion of the heating coil 120.

The gear cap 130 (FIG. 2) is formed at one end of the heating pipe 111. The gear cap 130 is injection molded by a resin, such as PPS (polyphenylene sulfide), PBT (polybutylene terephthalate) or nylon, which is stuffed with a filler such as a glass fiber exhibiting less thermal distortion even at a high temperature. In order to receive a rotation power from a power source through the gear connection, a gear tooth 131 is formed on the outer circumference of the gear cap 130. Also, a first electrode 135 to receive an AC voltage from the external source is formed at the center of the gear cap 130. The first electrode 135 is electrically connected to the first terminal block 150 which, is connected to one end of the heating coil 120.

The end cap 140 is provided at the other end of the heating pipe 111. Like the gear cap 130, the end cap 140 is injection molded by a resin, such as PPS, PBT or nylon with a filler, such as a glass fiber. A second electrode 145 is formed at the center of the end cap 140 and is electrically connected to the second terminal block 160, which is connected to the other end of the heating coil 120. Also, the end cap 140 includes an air vent 140*a* to prevent expansion of the expandable pipe 112 when the air within the expanded pipe 112 is heated.

Hereinafter, a method of manufacturing a fusing roller used with an image forming apparatus according to an embodiment of the present invention will be described in detail with reference to the accompanying drawings.

After formation of the inner insulating layer 115 on the outer circumference of the expandable pipe 112, the heating coil 120 is wound in an oblique direction on the outer circumference of the expandable pipe 112 to be uniformly distributed over the outer circumference, as illustrated in FIG. 3.

Figure 4A:
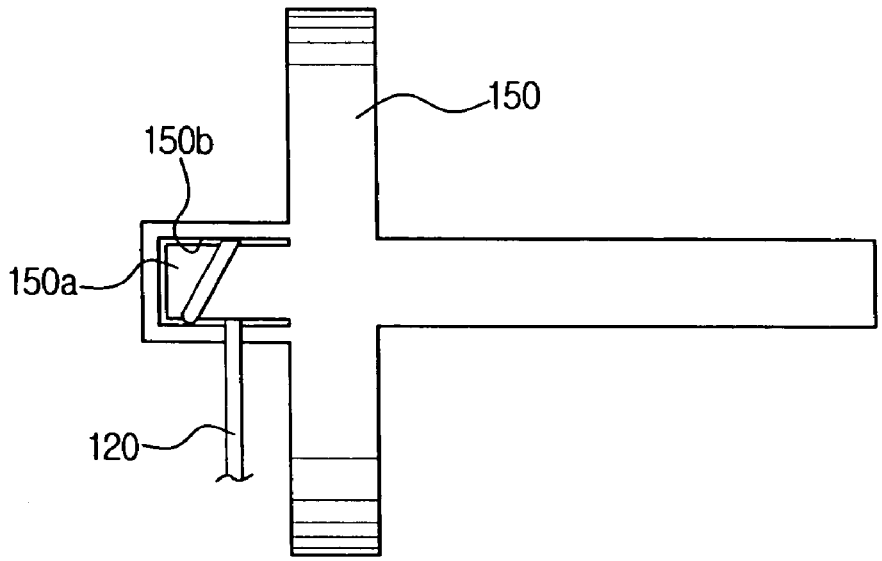
FIGS. 4A and 4B are plane views illustrating a process of manufacturing a fusing roller used with an image forming apparatus according to an embodiment of the present invention.

The terminal blocks 150 and 160 are formed by processing a phosphor bronze plate or a phosphodeoxy bronze plate which is made by treating the surface of the processed plate by chemical etching to remove residues, such as burrs, which may destroy the inner and outer insulating layers 115 and 114. As illustrated in FIG. 4A, one side of each of the terminal blocks 150 and 160 is slit to form a predetermined size of the slit section 150*a*. It is an aspect of the invention to form the slit section 150*a* in a rectangular shape so that the heating coil 120 can be well wound around the slit section 150*a*.

Figure 4B:
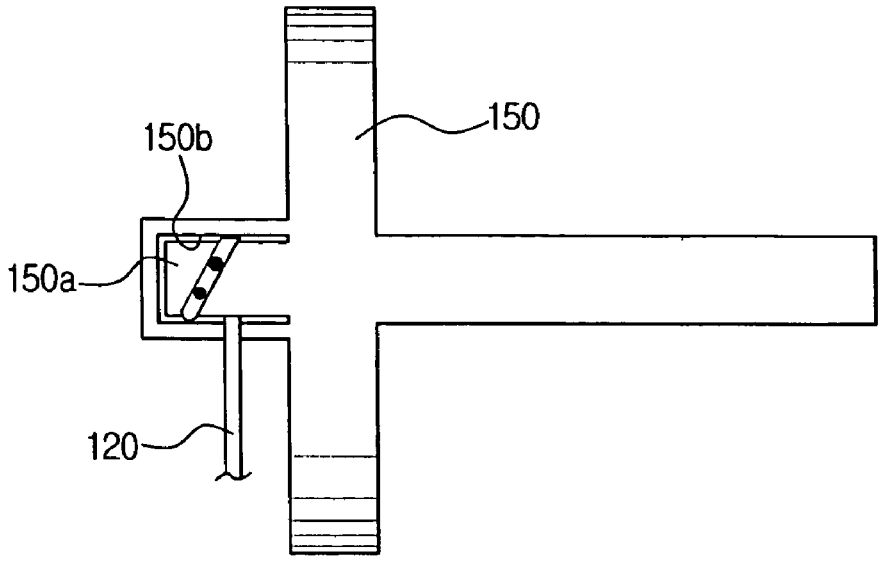

The first and second terminal blocks 150 and 160 are fixed to the respective ends of the expandable pipe 112 with the heating coil 120 wound thereon. As illustrated in FIG. 4A, each end of the heating coil 120 is wound tightly on the slit section 150*a* of each of the terminal blocks 150 and 160 through the slit 150*b*. Subsequently, as illustrated in FIG. 4B, both ends of the heating coil 120 are welded to be fixed onto the slit section 150*a* of the terminal blocks 150 and 160.

The method of welding the two ends of the heating coil 120 onto the terminal blocks 150 and 160 is not limited to a laser welding. Various welding methods can be used to fix the two ends of the heating coil 120 onto the terminal blocks 150 and 160. Further, the welding spots are not limited to two. Single-sided welding, three-sided welding or other spot welding can be applied depending on the size of the portion to be welded.

After the heating coil 120 is wound and connected to the terminal blocks 150 and 160, the expandable pipe 112 is inserted into the heating pipe 111 having the outer insulating layer 114 and the coating layer 113. Then, a high pressure is given to the inside of the expandable pipe 112 so as to expand the expandable pipe 112. As its external diameter is expanding, the expandable pipe 112 comes into contact with the outer insulating layer 114 formed on the inner circumference of the heating pipe 111. Next, the gear cap 130 and the end cap 140 are provided at the two ends of the heating pipe 111. The ends of the first and second terminal blocks 150 and 160 penetrate into the gear cap 130 and the end cap 140, respectively, to be exposed externally. Subsequently, the first and second electrodes 135 and 145 are formed at the centers of the gear cap 130 and the end cap 140, respectively, to contact the terminal blocks 150 and 160, respectively, so that external power can be supplied to the heating coil 120 through the first and second electrodes 135 and 145.

According to the embodiment of present invention as described above, the heating coil 120 is wound around the expandable pipe 112 and then welded at one side of each of the terminal blocks 150 and 160. Therefore, the heating coil 120 is not readily detached from the terminal blocks 150 and 160 even during repeated contraction and expansion. Since a stable connection between the heating coil 120 and the terminal blocks 150 and 160 is maintained, it is possible to prevent a sudden increase of temperature of the fusing roller 100, which may be caused by an unstable connection between the heating coil 120 and the terminal blocks 150 and 160.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A fusing roller used with an image forming apparatus, comprising:

a roller body;

a heating coil mounted within the roller body and generating a resistance heat when power is supplied thereto; and a terminal block connected to the heating coil to supply an external power to the heating coil, wherein the heating coil is wound about and welded to one side of the terminal block.

2. The fusing roller according to claim 1, wherein the heating coil is connected to the terminal block by laser welding.

3. The fusing roller according to claim 2, wherein the heating coil is connected to the terminal block by two-sided spot welding.

4. The fusing roller according to claim 1, wherein the terminal block comprises a partial slit at one side thereof to form a particular size of a slit section and the heating coil is wound and welded around the partial slit.

5. A fusing roller used with an image forming apparatus, comprising:

a heating pipe;

an expandable pipe mounted within the heating pipe;

a heating coil interposed between the heating pipe and the expandable pipe and generating a resistance heat when power is supplied thereto;

a terminal block connected to the heating coil to supply an external power to the heating coil;

an outer insulator interposed between the heating pipe and the heating coil; and an inner insulator interposed between the expandable pipe and the heating coil, wherein the heating coil is wound about and welded to one side of the terminal block.

6. The fusing roller according to claim 5, wherein the heating coil is connected to the terminal block by laser welding.

7. The fusing roller according to claim 6, wherein the heating coil is connected to the terminal block by two-sided spot welding.

8. The fusing roller according to claim 5, wherein said terminal block comprises a partial slit at one side thereof to form a particular size of a slit section and the heating coil is wound and welded around the partial slit.

9. A fusing roller used with an image forming apparatus, comprising:

a heating pipe with a Teflon coating applied on the outer surface thereof;

an expandable pipe mounted within the heating pipe;

a heating coil interposed between the heating pipe and the expandable pipe and generating a resistance heat when power is supplied thereto;

first and second terminal blocks connected to two respective ends of the heating coil to supply an external power to the heating coil;

a gear cap and an end cap provided at two respective ends of the heating pipe;

an outer insulator interposed between the heating pipe and the heating coil;

an inner insulator interposed between the expandable pipe and the heating coil; and first and second electrodes provided respectively at the gear cap and the end cap to be electrically connected to the first and second terminal blocks, wherein each end of the heating coil is wound about and welded to one side of each of the first and second terminal blocks.

10. The fusing roller according to claim 9, wherein the two ends of the heating coil are connected respectively to the first and second terminal blocks by laser welding.

11. The fusing roller according to claim 10, wherein the two ends of the heating coil are connected respectively to the first and second terminal blocks by two-sided spot welding.

12. The fusing roller according to claim 9, wherein one side of each of the terminal blocks is partially slit to form a particular size of a slit section and each end of the heating coil is wound and welded around the slit section.

13. A fusing roller, comprising:

a fusing roller body including an expandable pipe disposed therein;

a heating coil mounted within the fusing roller body around the expandable pipe to generate a resistance heat when applying a power thereto; and a connecting member to apply power to the heating coil, the connecting member surrounding a surface of the expandable pipe and being connected to the heating coil by spot welding.

14. The fusing roller according to claim 13, wherein the connecting member comprises a slit therein such that the heating coil is wound around the slit and welded to the connecting member via two-sided spot welding.

15. A fusing roller comprising:

a fusing roller body;

a heating coil mounted within the fusing roller body to generate a resistance heat when applying a power thereto; and a connecting member to apply power to the heating coil, the connecting member having a partial slit therein in which a portion of the heating coil is wound around the connecting member through the slit to secure the heating coil to the connecting member.

16. The fusing roller according to claim 15, wherein the portion of the heating coil wound within the slit of the connecting member is welded at one side of the connecting member.

17. The fusing roller according to claim 15, wherein the portion of the heating coil wound within the slit of the connecting member is welded to the connecting member at two sides thereof.

18. A fusing roller comprising:

a fusing roller body;

a heating coil mounted within the fusing roller body to generate a resistance heat when a power is applied to the heating coil; and a connecting member having an end section and a slit section, which is flexable with respect to the end section, the slit section being connected to the heating coil.

19. The fusing roller according to claim 18, wherein the connecting member comprises a partial slit formed between the end section and the slit section.

20. The fusing roller according to claim 19, wherein one end of the heating coil is inserted into the partial slit to be connected to the slit section of the connection member.

21. The fusing roller according to claim 20, wherein the connecting member comprises a main section coupled between the slit section and an external power connector.

22. The fusing roller according to claim 21, wherein the end section and the slit section are spaced apart from each other by a width of the slit formed between the end section and the slit section.

23. The fusing roller according to claim 21, wherein the heating coil is welded on the slit section.

24. A fusing roller usable in an image forming apparatus, comprising:

an expandable pipe;

a heating coil wound around the expandable pipe to heat the expandable pipe; and at least one terminal block disposed around an end of the expandable pipe having a projection with a slit through which the heating coil is wound and secured such that the at least one terminal block provides power to the heating coil.

* * * * *